US005786133A

United States Patent [19]

Smith

[11] Patent Number: 5,786,133

[45] Date of Patent: Jul. 28, 1998

[54] ANTISTATIC LAYER FOR PHOTOGRAPHIC ELEMENTS

[75] Inventor: Thomas M. Smith, Spencerport, N.Y.

[73] Assignee: Eastman Kodak Company, Rochester, N.Y.

[21] Appl. No.: 752,697

[22] Filed: Nov. 19, 1996

[51] Int. Cl.[6] ..... G03C 1/85; G03C 1/89; G03C 1/815

[52] U.S. Cl. ..... 430/512; 430/527; 430/530; 428/702; 252/518

[58] Field of Search ..... 252/518; 430/527, 430/530, 512; 428/702

[56] References Cited

U.S. PATENT DOCUMENTS

| | | | |
|---|---|---|---|
| 2,976,259 | 3/1961 | Hardy et al. | 430/512 |
| 4,195,999 | 4/1980 | Adachi et al. | 430/527 |
| 4,203,769 | 5/1980 | Guestaux | 430/530 |
| 4,464,462 | 8/1984 | Sugimoto et al. | 430/527 |
| 4,914,011 | 4/1990 | Grous | 430/422 |
| 4,999,276 | 3/1991 | Kuwabara et al. | 430/527 |
| 5,006,451 | 4/1991 | Anderson et al. | 430/527 |
| 5,221,598 | 6/1993 | Anderson et al. | 430/527 |
| 5,254,448 | 10/1993 | Yamada et al. | 430/527 |
| 5,356,468 | 10/1994 | Havens et al. | 106/195 |
| 5,360,706 | 11/1994 | Anderson et al. | 430/529 |
| 5,360,707 | 11/1994 | Kato et al. | 430/538 |
| 5,366,544 | 11/1994 | Jones et al. | 106/187 |
| 5,385,815 | 1/1995 | Schofield et al. | 430/512 |
| 5,427,835 | 6/1995 | Morrison et al. | 430/527 |
| 5,468,498 | 11/1995 | Morrison et al. | 524/408 |

FOREIGN PATENT DOCUMENTS

| | | |
|---|---|---|
| 4125758 | 2/1993 | Germany . |
| 93/24584 | 12/1993 | WIPO . |

*Primary Examiner*—Richard L. Schilling
*Attorney, Agent, or Firm*—Andrew J. Anderson

[57] ABSTRACT

A photographic element is disclosed comprising a support bearing at least one photosensitive layer and an antistatic layer comprising a binder, vanadium pentoxide, and an aromatic ketone ultraviolet absorbing compound. The antistatic layer provides the properties of UV absorbance and antistatic protection, which properties are retained after photographic processing. Specifically, in accordance with preferred embodiments, a layer providing a surface and volume resistivity of less than about $10^8$ ohm/cm coupled with an optical density of greater than about 1.0 from 300–400 nm and less than about 0.03 as measured in orthochromatic light is provided. The layer composition components are soluble in common coating solvents, compatible with each other, and do not produce any adverse sensitometric effects either in the raw state, during or after processing of the film itself.

16 Claims, 2 Drawing Sheets

ANTISTATIC LAYER FOR PHOTOGRAPHIC ELEMENTS

FIELD OF THE INVENTION

This invention relates to photographic elements having an antistatic layer comprising vanadium pentoxide as a conductive agent and an aromatic ketone compound as an ultraviolet absorbing agent.

BACKGROUND OF THE INVENTION

Photographic elements typically comprise some form of antistatic and antihalation protection. Antistatic protection is provided to prevent problems associated with electrostatic charges in the manufacture and utilization of imaging elements. The accumulation of charge can result in dirt or dust attraction, producing physical defects. The discharge of accumulated charge during application or use of radiation sensitive layers (for example, photographic emulsions) can produce irregular fog patterns or static marks in the light sensitive layer(s). These static charge problems have become increasingly more severe due to increased photographic emulsion sensitivity, increased coating machine speeds, and increased post-coating drying efficiency. Transport charging results from the tendency of high dielectric materials to accumulate electrical charge when in relative motion to other materials. This results in static charging during coating and post-coating operations such as slitting and spooling. Static charge build-up may also occur during use of imaging elements, for example during winding of a roll of photographic film out of and back into a film cassette in an automatic camera. Static discharge during reading and writing for films having a magnetic recording layer can result in increased bit error rates. These problems can be exacerbated at low relative humidities. Similarly, high speed processing of imaging elements can result in static charge generation.

Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method for providing antistatic and antihalation protection in photographic films comprises providing a carbon black pigmented layer behind a clear support as a backing layer, wherein the backing layer is designed to be removed during processing of the film, as disclosed in, e.g., U.S. Pat. No. 4,914,011. Typical examples of such backing layers comprise carbon black dispersed in an alkali-soluble polymeric binder (such as cellulose acetate hexahydrophthalate) that renders the layer removable by an alkaline photographic processing solution. Such backing layers have been commonly used for antihalation and antistatic protection in motion picture films. The dispersed carbon black in such layers also provides protection from radiation in the UV (ultraviolet) portion of the spectrum (specifically 300–400 nm) which can result from electrical discharges or sparking. Methods of eliminating static-generated sparks, as well as protection from such sparks, should they occur, are necessary components of any robust photographic product manufactured today. While removable carbon black backing layers provide effective pre-processing antistatic and UV protection and antihalation protection during exposure, their use requires special additional processing steps for their subsequent removal, and incomplete removal of the pigmented layer can cause image defects in the resulting print film. Additionally, such removable layers fail to provide any scratch and abrasion resistance, lubricity and antistatic protection for the processed element after their removal.

An alternative method for providing antihalation and antistatic protection for photographic materials comprises use of an antihalation undercoat layer containing filter dyes or silver metal coated between the support and the emulsion layers, wherein the filter dyes or silver is solubilized and removed during processing of the film without removal of the undercoat layer itself, in combination with a preferably process surviving antistatic layer coated on the back side of the support. Alternatively, it has also been proposed to incorporate filter dyes which effectively provide filter or antihalation protection in an organic solvent coated layer, which itself is not removed during photographic processing, on the backside of a photographic element, where such dyes are solubilized and removed or at least decolorized during processing with an alkaline photographic processing solution, as described in copending, commonly assigned U.S. patent application Ser. No. 08/698,413 of Brick et al., filed Aug. 15, 1996, the disclosure of which is hereby incorporated by reference. Process surviving antistatic layers incorporating a wide variety of ionically-conducting and electronically-conducting materials have been proposed for use in such photographic imaging elements employing antihalation layers. The requirements for transparent antistatic layers in silver halide photographic films are especially demanding because of the stringent optical requirements associated with such films.

Electrically conductive antistatic layers comprising vanadium oxide gels dispersed in polymeric binders are well known as disclosed in U.S. Pat. No. 4,203,769, and such antistatic materials provide effective antistatic protection at advantageously low coverages. One problem associated with the use of vanadium pentoxide as an antistat, however, is its sensitivity toward combination with various other materials. Vanadium pentoxide is a strong oxidizing agent which reacts with a number of organic functionalities. Accordingly, it has not been trivial to include vanadium pentoxide in a single layer with other common functional photographic components. Therefore, its utility has been somewhat limited by this inherent incompatibility. Much prior art has been directed towards providing stable vanadium pentoxide compositions. U.S. Pat. Nos. 5,356,468, 5,360,707, 5,366,544 and 5,427,835, e.g., disclose antistatic layer compositions directed towards improving the stability of $V_2O_5$.

It would be desirable to provide both antistatic properties as well as UV protection in a single layer, like that obtained from a removable carbon black layer, but wherein the layer was transparent in the visible spectrum so as it would not need to be removed as the carbon layers are. Methods of providing protection from UV radiation include incorporation of a UV absorber within one of the many layers generally comprising a photographic element. The prior art fails to teach, however, stable antistatic layer compositions comprising vanadium pentoxide which provide effective UV spark protection as well as antistatic protection.

PROBLEMS TO BE SOLVED

There is need for a functional film backing having antistatic properties, UV absorption and yet be essentially transparent in the visible region of the spectrum.

Specifically, a backing layer providing a surface and volume resistivity of less than about $10^8$ ohm/cm coupled with a density of greater than about 1.0 from 300–400 nm is desired. An optical density of less than about 0.03 as measured in orthochromatic light is particularly desired. In addition to meeting these criteria, the layer composition components are desirably soluble in common coating solvents, compatible with each other, and do not produce any adverse sensitometric effects either in the raw state, during or after processing of the film itself.

SUMMARY OF THE INVENTION

An objective of this invention is to provide a photographic film element containing vanadium pentoxide and a UV absorbing agent in a permanent layer on the back of the film support, such that the layer provides the properties of UV absorbance and antistatic protection, which properties are retained after photographic processing.

In accordance with one embodiment of the invention, a photographic element is disclosed comprising a support bearing at least one photosensitive layer and an antistatic layer comprising a binder, vanadium pentoxide, and an aromatic ketone ultraviolet absorbing compound.

ADVANTAGES OVER PRIOR ART

The present invention provides photographic elements wherein pre-processing physical properties of antistatic and UV protection can be obtained which are comparable or superior to the prior art of removable backing layers containing carbon, while such properties are also advantageously retained after processing, unlike films that contain carbon on the back of the support. Additionally, in accordance with preferred embodiments of the invention, the properties of post-processing abrasion resistance and lubricity may also be achieved. This is especially desirable for motion picture film materials, which are subject to continued rapid transport processes even after photographic processing.

DETAILED DESCRIPTION OF THE INVENTION

Figure 1A:
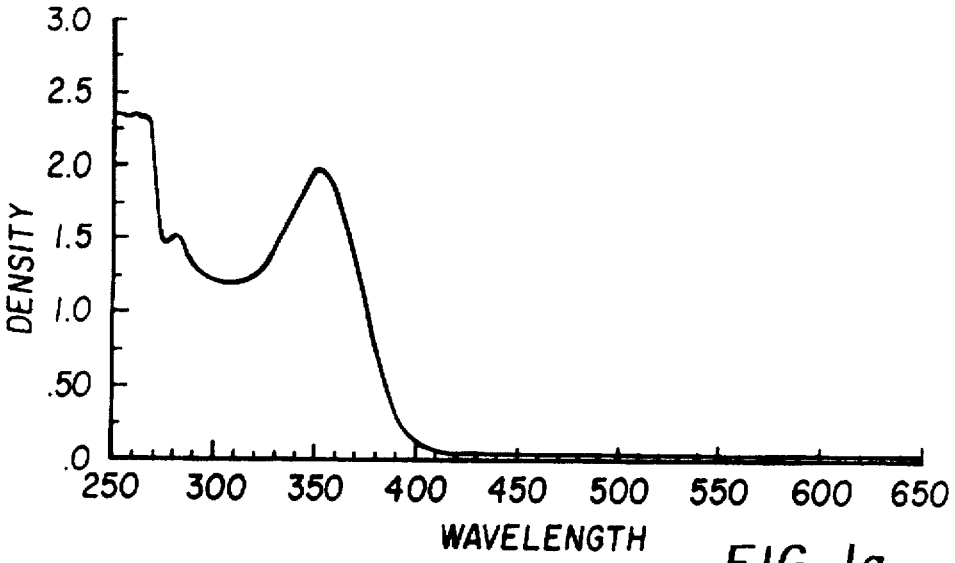
FIG. 1*a*, FIG. 1*b*, and FIG. 1*c* depict spectral curves for coatings of ultraviolet absorbing compounds in accordance with the invention.

The invention is directed towards photographic elements containing antistatic layers comprising a conductive agent and an ultraviolet absorbing compound, where the conductive agent comprises vanadium pentoxide. Vanadium pentoxide is particularly useful in the form of a conductive "amorphous" gel comprised of vanadium oxide ribbons or fibers, as layers comprising such conductive agents have been found to present particularly advantageous antistatic performance. Such vanadium oxide gels may be prepared by any variety of methods, including but not specifically limited to melt quenching as described in U.S. Pat. No. 4,203,769, ion exchange as described in DE 4,125,758, or hydrolysis of a vanadium oxoalkoxide as described in WO 93/24584. The vanadium oxide gel is preferably doped with silver to enhance conductivity. Other methods of preparing vanadium oxide gels which are well known in the literature include reaction of vanadium or vanadium pentoxide with hydrogen peroxide and hydrolysis of $VO_2OAc$ or vanadium oxychloride.

UV absorbers comprising aromatic ketone compounds in accordance with the invention have been found to be soluble in alcohol and ketone solvents, compatible with vanadium pentoxide and cellulosic binders, and produce clear, colorless coatings. In accordance with preferred embodiments of the invention, the ultraviolet absorbing compound comprises a diphenyl ketone compound (i.e., a benzophenone) or a diphenyl beta-diketone compound (i.e., a benzilidene malonate). Such compounds may be represented by the following general formula:

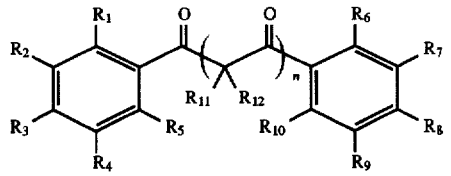

wherein n=0 or 1 and each of $R_1$–$R_{12}$ independently represents hydrogen or a photographically acceptable substituent. Representative photographically acceptable substituents may be selected from, e.g., an alkyl group (for example, methyl, propyl, hexyl), an aryl group (for example, phenyl), a hetercyclic group, an alkoxy group (for example, methoxy, 2-methoxyethoxy), an aryloxy group (for example, 2,4-di-tert-amyl phenoxy, 2-chlorophenoxy, 4-cyanophenoxy), an alkenyloxy group (for example, 2-propenyloxy), an acyl group (for example, acetyl, benzoyl), an ester group (for example, butoxycarbonyl, phenoxycarbonyl, acetoxy, benzoyloxy, butoxysulfonyl, toluenesulfonyloxy), an amido group (for example, acetylamino, methanesulfonamido, dipropylsulfamoylamino), a carbamoyl group (for example, dimethylcarbamoyl, ethylcarbamoyl), a sulfamoyl group (for example, butylsulfamoyl), an imido group (for example, succinimido, hydantoinyl), a ureido group (for example, phenylureido, dimethylureido), an aliphatic or aromatic sulfonyl group (for example, methanesulfonyl, phenylsulfonyl), an aliphatic or aromatic thio group (for example, ethylthio, phenylthio), a hydroxy group, a cyano group, a carboxy group, a nitro group, a sulfo group, and a halogen atom. In preferred embodiments of the invention, each of $R_1$–$R_{12}$ independently represents hydrogen or a hydroxy, alkyl, or alkoxy group, and when n=0, at least one of $R_1$ and $R_6$ is preferably a hydroxy group.

Compounds wherein n=0, $R_1$ and $R_6$ each represent a hydroxy group, and $R_3$ and $R_8$ each represent a hydroxy, alkyl or alkoxy group, or wherein n=1 and $R_3$ and $R_8$ each preferably represents a hydroxy, alkyl or alkoxy group, are particularly preferred as such compounds have advantageously been found to provide significant protection from radiation throughout substantially the entire 300–400 nm range, with minimal absorption in the visible region.

Aromatic ketone UV absorbing compounds in accordance with the invention are commercially available, and may be synthesized using conventional processes. Specific examples of aromatic ketone UV absorbing compounds in accordance with the invention include the following:

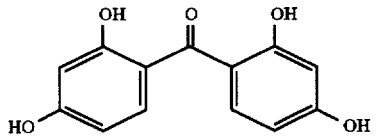

U-1

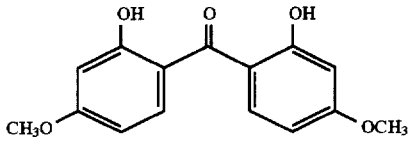

U-2

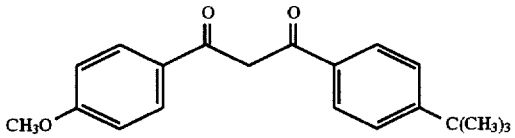

U-3

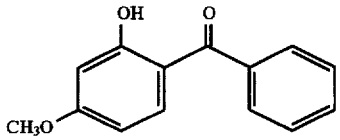

U-4

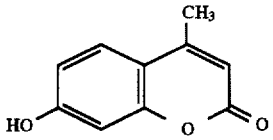

U-5

These materials appear to be uniquely suited for producing colorless, transparent antistatic backing layers in conjunction with $V_2O_5$ antistat material. These UV absorbers have passed photographic activity testing to assure that there are no adverse sensitometric effects caused by their use. Compounds U-1, U-2, and U-3 in accordance with particularly preferred embodiments have been found to provide an advantageously sharp cut off in absorption at about 400 nm, enabling optical densities of 1.0 or greater throughout the range of about 300 to about 400 nm to be achieved while keeping densities below 0.02 in the visible region above 400 nm.

The antistatic backing layers of this invention may be coated from any conventional organic solvent, such as a polar organic medium or a substantially non-polar aromatic hydrocarbon or halogenated hydrocarbon, or water/solvent blend. Examples of suitable organic solvents are amines, ethers, organic acids, esters, ketones, glycols, alcohols and amides. Preferred polar organic liquids are dialkyl ketones, alkyl esters of alkane carboxylic acids and alcohols, especially such liquids containing up to, and including, a total of 6 carbon atoms. Examples of such liquids are dialkyl and cycloalkyl ketones such as acetone, methyl-ethylketone, di-ethylketone, di-iso-propylketone, methyl-iso-butylketone, di-iso-butylketone, methyl-iso-amylketone, methyl-n-amylketone and cyclohexanone; alkyl esters such as methyl acetate, ethyl acetate, propyl acetate, isopropyl acetate, butyl acetate, methyl acetoacetate, ethyl formate, methyl propionate and ethyl butyrate, glycols and glycol esters and ethers, such as ethylene glycol, 2-ethoxyethanol, 3-methoxypropylpropanol, 3-ethoxypropylpropanol, 2-butoxyethyl acetate, 3-methoxypropyl acetate, 3-ethoxypropyl acetate and 2-ethoxyethyl acetate, alcohols such as methanol, ethanol, n-propanol, isopropanol, n-butanol and isobutanol and diallyl and cyclic ethers such as diethylether and tetrahyrofuran.

Preferred organic solvents include those commonly used in manufacture of photographic elements, such as ethyl acetate, propyl acetate, methanol, ethanol, butanol, n-propanol, methyl acetoacetate, and acetone.

Binders used in the antistatic layer in accordance with preferred embodiments of the invention may comprise any organic solvent-soluble cellulosic material which forms a substantially aqueous photographic processing solution insoluble film. The film forming binders preferably comprise water insoluble cellulose or cellulose derivatives such as cellulose nitrate, cellulose acetate, cellulose diacetate, cellulose triacetate, cellulose acetate butyrate, and cellulose acetate propionate, and the like. For effective abrasion resistance, the film forming binders preferably have a glass transition temperature of about 20° C. or higher, more preferably about 40° C. or higher.

Useful coating solvents and binder combinations for vanadium pentoxide antistatic layer compositions are disclosed in U.S. Pat. Nos. 5,356,468 and 5,366,544, the disclosures of which are incorporated herein by reference.

It is preferred that the ratio of binder/vanadium oxide in the antistatic layers of the invention be in the weight ratio of 1/2 to 300/1 and more preferably from approximately 1/1 up to 200/1. The aromatic ketone UV absorbing compounds in accordance with the invention are preferrably incorporated into the antistatic layer at coverages of at least 0.01 $g/m^2$, more preferably at least 0.1 $g/m^2$, and most preferably at least 0.2 $g/m^2$ to provide effective UV protection. Coverages of the UV absorbing compounds are preferably maintained below 0.5 $g/m^2$, more preferably below 0.3 $g/m^2$, to minimize layer thickness. The required overall coverage of the electrically conductive antistatic layer depends on an appropriate thickness to achieve the desired resistivity level which is determined in a large part on the polymeric binder to vanadium oxide ratio. Preferred coverages range from approximately 0.1 to 1.50 $g/m^2$ with the higher coverages preferred at higher binder/vanadium oxide ratios.

Any suitable film support may be employed in the practice of this invention, such as, cellulose derivatives including cellulose diacetate, cellulose triacetate, cellulose propionate, cellulose butyrate, cellulose acetopropionate and the like; polyamides; polycarbonates; polyesters, particularly polyethylene terephthalate, poly-1,4-cyclohexanedimethylene terephthalate, polyethylene 1,2 -diphenoxyethane-4,4'-dicarboxylate, polybutylene terephthalate and polyethylene naphthalate; polystyrene, polypropylene, polyethylene, polymethylpentene, polysulfone, polyethersulfone, polyarylates, polyether imides and the like. Particularly preferred supports are polyethylene terephthalate, polyethylene naphthalate and the cellulose esters particularly cellulose triacetate. Depending on the nature of the support, suitable transparent tie or undercoat layers may be desired. Particularly with regard to polyester supports, primers are used in order to promote adhesion of coated layers. Any suitable primers in accordance with those described in the following U.S. patents, e.g., may be employed: U.S. Pat. Nos. 2,627,088; 3,501,301; 4,689,359; 4,363,872; and 4,098,952.

The antistatic layer of the present invention may optionally be overcoated with a wide variety of additional functional or auxiliary layers such as abrasion resistant layers, curl control layers, transport control layers, lubricant layers, image recording layers, additional adhesion promoting layers, layers to control water or solvent permeability, and transparent magnetic recording layers. Magnetic layers suitable for use in the imaging elements in accordance with the invention include those as described, e.g., in *Research Disclosure*, November 1992, Item 34390. *Research Disclosure* is published by Kenneth Mason Publications, Ltd., Dudley House, 12 North Street, Emsworth, Hampshire P010 7DQ, ENGLAND.

To provide protection of the antistatic layer, a protective overcoat or barrier layer is preferably applied thereon. The protective layer can chemically isolate the antistatic layer and also serve to provide additional scratch and abrasion resistance. Permeability control protective layers are particularly useful for protecting those antistatic agents for which conductivity may degrade upon exposure to photographic processing solutions such as vanadium oxide gels. The protective overcoat layers may comprise, e.g., cellulose esters, cellulose nitrate, polyesters, acrylic and methacrylic copolymers and homopolymers, polycarbonates, polyvinyl formal polymethyl methacrylate, polysilicic acid, polyvinyl alcohol, and polyurethanes. Preferred permeability control layers comprise relatively hydrophobic polymers, including cellulose esters such as cellulose diacetate and cellulose triacetate, polyesters, and poly(alkyl (meth)acrylates). The chemical resistance of the overcoat can be improved by incorporating a polymer cross-linking agent for those overcoats that have functionally cross-linkable groups. Cross-linking agents such as aziridines, carbodiimide, epoxys, and the like are suitable for this purpose.

Matting agents are also preferably included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be silica, calcium carbonate, other mineral oxides, glass spheres, ground polymers and high melting point waxes, and polymeric matte beads.

The photographic elements according to this invention may also be preferably provided with a lubricating layer, such as a wax layer, on, over, or within the antistatic layer. Suitable lubricants include silicone oil, silicones having polar groups, fatty-acid modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, long chain (e.g., greater than $C_{17}$) fatty amides such as stearamide, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), fatty acid esters of monoalkyl ethers of alkylene oxide polymers, fatty acid amines having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, docosanoic acid, butyl stearate, oleic acid, linolic acid, linolenic acid, elaidic acid, octyl stearate, amyl stearate, isooctyl stearate, sodium stearate, sodium hexadecyl sulfate, octyl myristate, butoxyethyl stearate, anhydrosorbitan monostearate, anhydrosorbitan distearate, pentaerythrityl tetrastearate, batyl alcohol, oleyl alcohol and lauryl alcohol. Carnauba wax dispersed in an organic liquid such as a low molecular weight alcohol is preferred. Such dispersions are commercially available from the Daniel Products Company as SLIP-AYD SL508. The elements may also include a polyimide-siloxane block copolymer or polyester-siloxane block copolymer in an outermost backing layer as disclosed in copending, commonly assigned U.S. patent application Ser. Nos. 08/752,338 (Kodak Docket No. 74674AJA) and 08/752,339 (Kodak Docket No. 74776AJA), concurrently filed herewith, the disclosures of which are incorporated by reference herein.

Generally, photographic elements in accordance with the invention are prepared by coating a support film on the side opposite the antistatic layer with one or more photosensitive layers comprising a silver halide emulsion in an aqueous solution of gelatin and optionally one or more aqueous coated gelatin subbing, inter, or overcoat layers. The aqueous coated layers may be coated before or after the backing layer is coated, but is preferably coated after solvent coating of backing layers is performed. The coating processes can be carried out on a continuously operating machine wherein a single layer or a plurality of layers are applied to the support. For multicolor elements, layers can be coated simultaneously on the composite support film as described in U.S. Pat. Nos. 2,761,791 and 3,508,947. Additional useful coating and drying procedures are described in Research Disclosure, Vol. 176, December 1978, Item 17643. Suitable photosensitive image forming layers are those which provide color or black and white images.

Photographic elements which can be provided with an antistatic layer in accordance with the invention can differ widely in structure and composition. For example, they can vary greatly in the type of support, the number and composition of image-forming layers, and the kinds of auxiliary layers that are included in the elements. In particular, the photographic elements can be still films, motion picture films, x-ray films, graphic arts films, prints, or microfiche. They may be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Elements in accordance with the invention may be adapted for use in a negative-positive process or for use in a reversal process.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like. Photographic elements in accordance with one embodiment of the invention are preferably used in conjunction with an applied magnetic layer as described in *Research Disclosure*, November 1992, Item 34390. It is also specifically contemplated to use composite supports according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

The photosensitive layers can be image-forming layers containing photographic silver halides such as silver chloride, silver bromide, silver bromoiodide, silver chlorobromide, and the like. Both negative working and reversal silver halide elements are contemplated. Suitable emulsions and film formats, as well as examples of other compounds and manufacturing procedures useful in forming photographic imaging elements in accordance with the invention, can be found in *Research Disclosure*, September 1994, Item 36544, and the patents and other references cited therein, the disclosures of which are incorporated herein by reference. The preparation of single and multilayer photographic elements is also described in *Research Disclosure* 308119 dated December 1989, the disclosure of which is incorporated herein by reference. It is specifically contemplated that the film formats, materials and processes described in an article titled "Typical and Preferred Color Paper, Color Negative, and Color Reversal Photographic Elements and Processing," published in *Research Disclosure*, February 1995, Volume 370, the disclosure of which is incorporated herein by reference, may also be advantageously used with the antistatic backing layers of the invention.

In accordance with a preferred embodiment of the photographic elements of the invention, an antihalation layer comprising filter dyes is included either between the support and the light sensitive emulsion layers, or on the back side of the support (e.g., as described in copending application U.S. Ser. No. 08/698,413 filed Aug. 15, 1996, referenced above). The incorporation of filter dyes which are relatively insoluble in organic solvent based coating solutions or aqueous coating solutions at aqueous coating pH's of less than 7, and readily soluble and/or decolorizable at alkali processing pH's of above 8, in the form of solid particle dispersions is particularly preferred, as disclosed in, e.g., Lemahieu et al in U.S. Pat. No. 4,092,168, Ailliet et al in U.S. Pat. No. 4,770,984, Factor et al in U.S. Pat. No. 4,900,653 and Diehl et al in U.S. Pat. No. 4,940,654. Exemplary filter dyes which may be used in the photographic elements of the invention include those in Tables I to X of WO 88/04794, formulas (I) to (VII) of EP 0 456 163 A2, formula (II) of EP 0 594 973, and Tables I to XVI of U.S. Pat. No. 4,940,654.

Solid particle filter dyes coated in an emulsion layer side undercoat or as a backing layer can be essentially completely removed or decolorized from photographic elements upon photographic processing with an alkaline aqueous processing solution. The described elements can be, e.g., processed in conventional commercial photographic processes, such as the known C-41 color negative and RA-4 color print processes as described in *The British Journal of Photography Annual* of 1988, pages 191–199. Motion picture films may be processed with ECN or ECP processes as described in Kodak Publication No. H-24, Manual For Processing Eastman Color Films. Where applicable, the element may be processed in accordance with the Kodak Ektaprint 2 Process as described in Kodak Publication No. Z-122, using Kodak Ektaprint chemicals. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197.

The invention will be further illustrated by the following examples in which parts and percentages are given by weight unless otherwise specified.

Figure 1B:
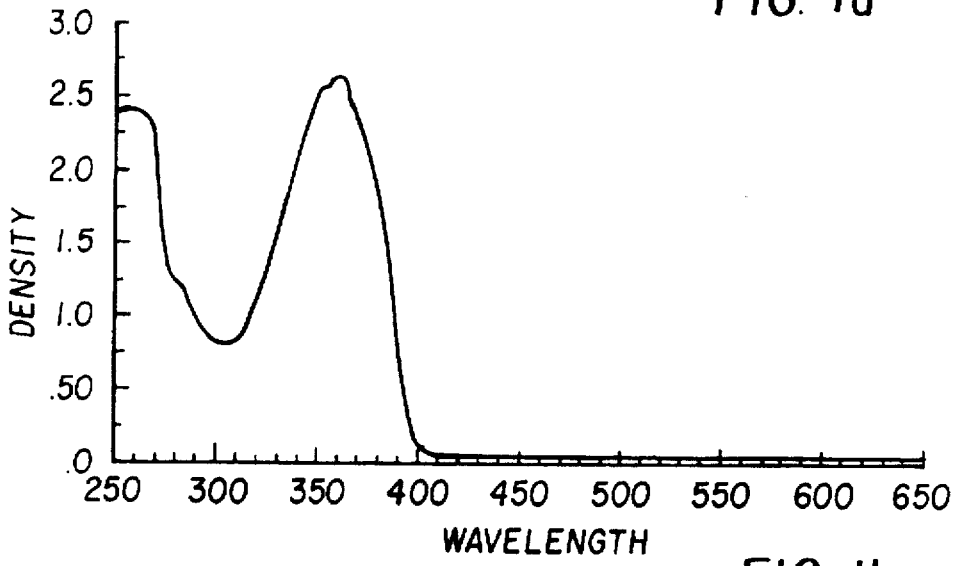
Figure 1C:
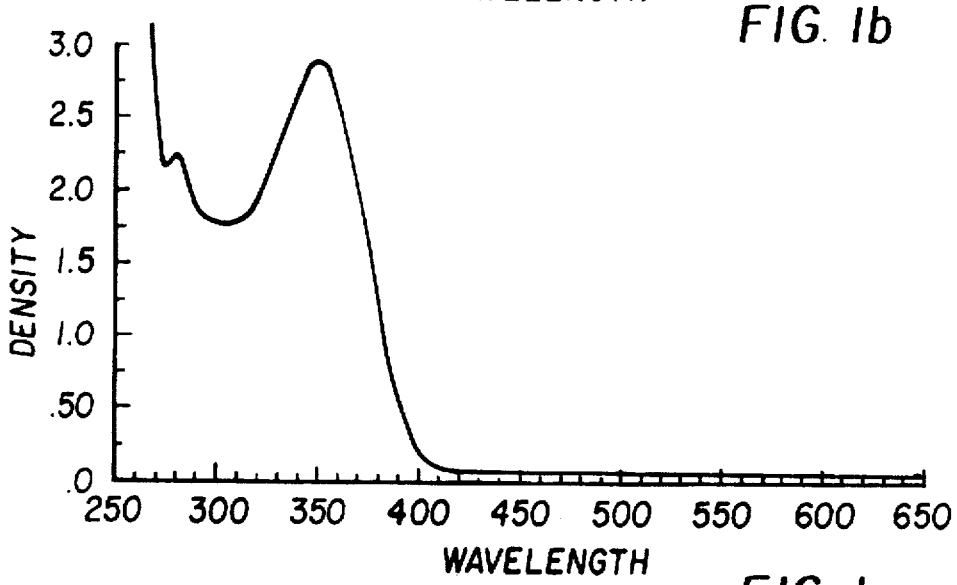

Ultraviolet absorbing compound U-1 (UVINUL 3050, available from BASF Corp.) was combined with an equal weight of cellulose diacetate and dissolved in a 60/40 (weight %) blend of acetone and methanol. The solution was coated on a cellulose triacetate support to provide a dry coating having a coverage of approximately 540 mg/m$^2$ (Coating 1*a*). The same was done with compound U-3 (GIVSORB UV-14, available from Givaudan-Roure Corp.) (Coating 1*b*), and a commercial mixture of compounds U-1 and U-2 (UVINUL 3093, available from BASF Corp.) (Coating 1*c*). The resulting spectral curves, in the range of 250–650 nm, for Coating 1*a*–1*c* are shown in FIGS. 1*a*–1*c*, respectively. These coatings were subsequently aged for a period of four weeks at 40° C. Spectral curves run after this incubation were virtually identical to those in the fresh state. This indicated substantially no degradation, crystallization, or incompatibility of the UV absorbing compounds with the cellulosic binder.

Figure 2A:
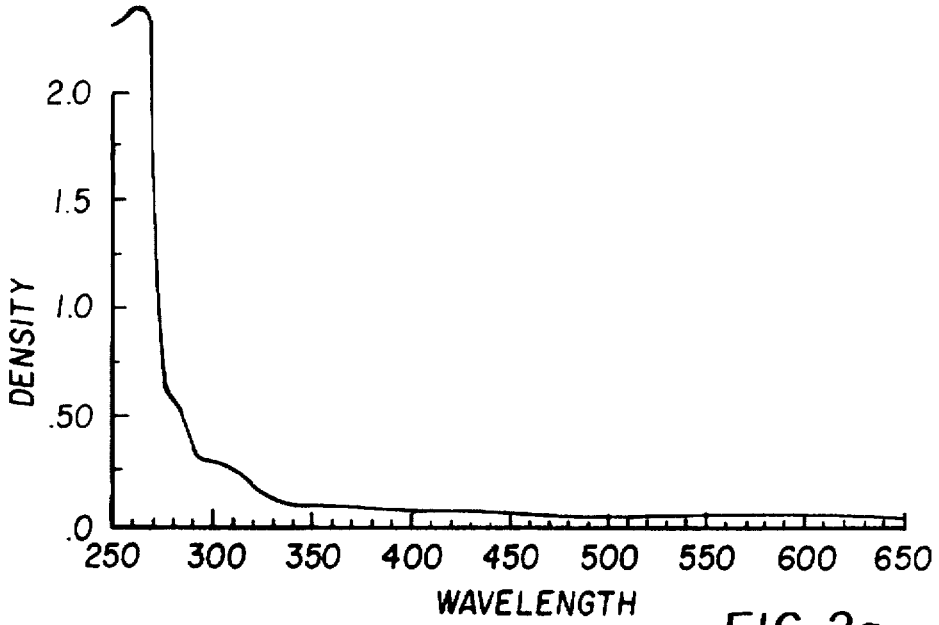
FIG. 2*a* depicts a spectral curve for a comparison vanadium pentoxide antistatic layer containing no ultraviolet absorbing compound.
Figure 2B:
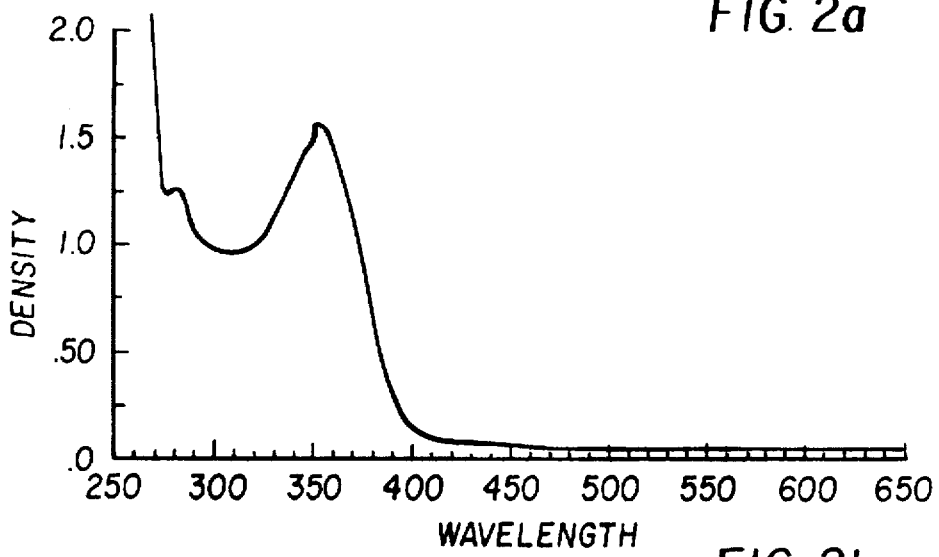
FIG. 2*b* and FIG. 2*c* depict spectral curves for vanadium pentoxide antistatic layers containing ultraviolet absorbing compounds in accordance with the invention.
Figure 2C:
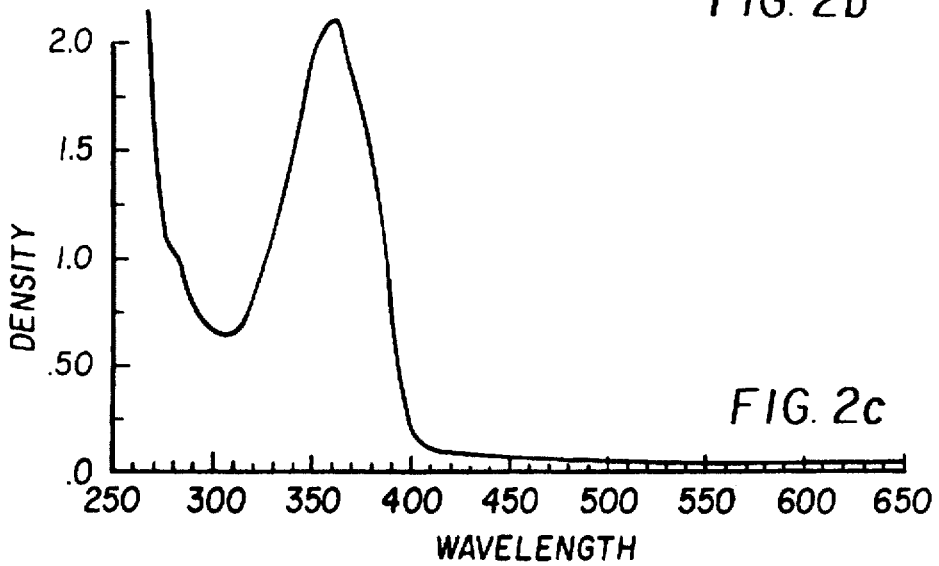

A formulation comprising of cellulose nitrate binder and $V_2O_5$ at a 2:1 weight ratio was prepared at 2% solids in a blend of 60% denatured ethanol, 36% acetone, and 4% water. The formulation was applied to cellulose triacetate supports at a dry coverage of 32 mg/M$^2$ (comparison Coating 2*a*). To protect the $V_2O_5$ from processing fluids, the coating was overcoated with a 108 mg/M$^2$ layer of poly (methyl methacrylate) from a 1% solids solution in 50% acetone and 50% methanol. Formulations in accordance with the invention comprising 63% UV absorbing compound U-1 (UVINUL 3050) (Coating 2*b*) or U-3 (GIVSORB UV-14) (Coating 2*c*), 34% cellulose nitrate binder, and 3% $V_2O_5$ were also prepared at 2% solids in a blend of 60% denatured ethanol, 36% acetone, and 4% water. The Coating 2*b* and 2*c* formulations were applied to cellulose triacetate supports at a dry coverage of 323 mg/m$^2$, and overcoated with a 108 mg/M$^2$ layer of poly(methyl methacrylate) as with Coating 2*a*. The coatings were subsequently subjected to conventional ECN-2 photographic processing. The orthochromatic optical density and electrical resistivity (both before and after photographic processing) of these coatings are shown in Table I. The spectral absorption curves for Coating 2*a*–2*c* are shown in FIGS. 2*a*–2*c*, respectively.

TABLE I

| | | | Wet Electrical Resistivity (log ohm/cm) | |
|---|---|---|---|---|
| Coating | UV Absorber | Optical Density | un-processed | processed |
| 2a | none | 0.02 | 8.4 | 8.5 |
| 2b | U-1 | 0.02 | 7.1 | 7.6 |
| 2c | U-3 | 0.02 | 7.0 | 7.4 |

The spectral curves after ECN-2 photographic processing were essentially identical to those obtained before processing, indicating no loss of UV absorber during the processing operation. It is also shown by the resistivity values presented in Table I that the vanadium pentoxide remains unaffected during processing. The optical density in the visible region of the spectrum is 0.02 which is fully acceptable for use in typical photographic elements. Supports with Coatings 2*b* and 2*c* may be subsequently coated with a photosensitive layer and any desired auxiliary layers as is well known in the art to obtain photographic elements in accordance with the invention.

Similar formulations to those of Coatings 2b and 2c were prepared using poly(methyl methacrylate) as the binder in place of cellulose nitrate. The formulations consisted of 65% UV absorbing compound, 32% binder and 3% $V_2O_5$ prepared at 2% solids in a blend of 45% denatured ethanol, 65% acetone, and 5% water. These formulations resulted in gross precipitation of the vanadium pentoxide in combination with the acrylic binder. However, individually, both the acrylic binder and the vanadium pentoxide are soluble in the solvent blend.

Each of compounds U-1 through U-5 has been found to be soluble in acetone/methanol solvent blends (a preferred coating solvent), compatible with cellulose nitrate (a preferred binder), and produce clear, visibly colorless coatings. Each compound has also been found to be compatible with vanadium pentoxide at a ratio of 19:1 UV absorber to $VZO_5$. Compounds U-4 (SYNTASE 62, available from Great Lakes Chemical Corp.) and U-5, however, exhibit rather limited absorbance in the 350–400 nm range and are accordingly considered less desirable for robust protection against all forms of static sparking. Many other photographically useful compounds, in comparison, such as the UV absorbing compound 1,10 phenanthroline (Comp-1) have been found to produced a precipitation within such a formulation.

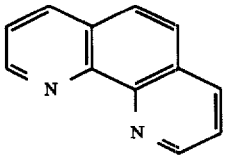

Comp-1

Many other UV absorbing compounds, while being excellent UV absorbers, demonstrate undesirable excessive absorbance at wavelengths above 400 nm, including azo-materials such as 4-phenylazophenol and 2-(4-hydroxyphenyl azo) benzoic acid. Even the thinnest practical coatings of such materials result in a noticeable yellow cast to the coating and would be considered unacceptable for the proposed photographic application. Other UV absorbers, on the other hand, may demonstrate very limited solubility in acetone, methanol, or blends of the two solvents such as materials like 4,4'-benzylidenebis (N,N-dimethylaniline), also known as Leucomalachite Green, and ammonium tetrathiocyanatodiamminechromate (III), also known as Reinecke Salt. In addition, these two materials exhibit very sharp cut-off in absorbance at above 350 nm.

The invention has been described in detail with particular reference to preferred embodiments thereof, but it will be understood that variations and modifications can be effected within the spirit and scope of the invention.

I claim:

1. A photographic element comprising a support bearing at least one photosensitive layer and an antistatic layer comprising a binder, vanadium pentoxide, and an aromatic ketone ultraviolet absorbing compound.

2. A photographic element in accordance with claim 1, wherein the binder comprises a cellulosic compound.

3. A photographic element in accordance with claim 2, wherein the binder comprises cellulose nitrate.

4. A photographic element in accordance with claim 2, wherein the ultraviolet absorbing compound comprises a diphenyl ketone.

5. A photographic element in accordance with claim 2, wherein the ultraviolet absorbing compound comprises a diphenyl beta-diketone.

6. A photographic element in accordance with claim 2, wherein the ultraviolet absorbing compound is of the following formula:

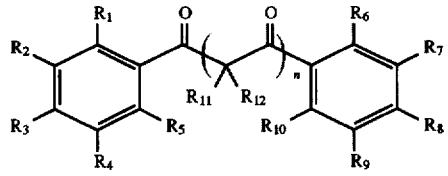

wherein n=0 or 1 and each of $R_1$–$R_2$ independently represents hydrogen or a photographically acceptable substituent.

7. A photographic element in accordance with claim 6, wherein each of $R_1$–$R_{12}$ independently represents hydrogen or a hydroxy, alkyl, or alkoxy group.

8. A photographic element in accordance with claim 7, wherein n=0 and at least one of $R_1$ and $R_6$ is a hydroxy group.

9. A photographic element in accordance with claim 6, wherein n=0, $R_1$ and $R_6$ each represent a hydroxy group, and $R_3$ and R each represent a hydroxy, alkyl or alkoxy group.

10. A photographic element in accordance with claim 6, wherein n=1.

11. A photographic element in accordance with claim 10, wherein $R_3$ and $R_8$ each represents a hydroxy, alkyl or alkoxy group.

12. A photographic element in accordance with claim 6, wherein the antistatic layer provides an optical density of at least about 1.0 throughout the range of about 300 to about 400 nm, and an optical density of less than about 0.02 in the visible region.

13. A photographic element in accordance with claim 6, wherein the support comprises a transparent polymeric film.

14. A photographic element in accordance with claim 13, wherein the support comprises a cellulose acetate film.

15. A photographic element in accordance with claim 13, wherein the support comprises a polyester film.

16. A photographic element in accordance with claim 1, wherein the antistatic layer is overcoated with a permeability control layer for reduced water permeability.

* * * * *

UNITED STATES PATENT AND TRADEMARK OFFICE

CERTIFICATE OF CORRECTION

PATENT NO. : 5,786,133

DATED : July 28, 1998

INVENTOR(S) : Thomas M. Smith

It is certified that error appears in the above-identified patent and that said Letters Patent is hereby corrected as shown below:

Col. 12, Claim 9, line 35 Delete "R" and insert --$R_8$--.

Signed and Sealed this

Twelfth Day of January, 1999

*Attest:*

*Attesting Officer*

*Acting Commissioner of Patents and Trademarks*